United States Patent [19]

Roy

[11] Patent Number: 4,637,152

[45] Date of Patent: Jan. 20, 1987

[54] ROTARY DRIVE MECHANISM FOR ENERGIZING TOYS, KINETIC SCULPTURES, OR THE LIKE

[76] Inventor: David C. Roy, 32 Frontage Rd., Stafford Springs, Conn. 06076

[21] Appl. No.: 493,726

[22] Filed: May 11, 1983

[51] Int. Cl.[4] ..... G09F 11/04

[52] U.S. Cl. ..... 40/495; 40/421; 446/248; 446/236; 74/141; 74/64; 74/1.5; 185/31

[58] Field of Search ..... 446/247, 249, 252, 248, 446/243, 244, 245, 246, 265, 266, 462, 463, 464, 236; 192/105 CD; 74/1.5, 138, 141, 64; 185/31, 5, 38, 4, 27; 40/435, 421, 437, 423, 485, 493, 495, 496, 509; 273/368, 359

[56] References Cited

U.S. PATENT DOCUMENTS

| | | | |
|---|---|---|---|
| 435,279 | 8/1890 | Canedy | 74/141 |
| 935,406 | 9/1909 | Riddle | 74/141 X |
| 4,042,242 | 8/1977 | Nicholls et al. | 273/368 |
| 4,341,035 | 7/1982 | Jaworski et al. | 446/341 |

*Primary Examiner*—Mickey Yu

*Attorney, Agent, or Firm*—McCormick, Paulding & Huber

[57] ABSTRACT

A rotary drive mechanism for toys, kinetic sculptures, and the like, employs a pawl and ratchet mechanism to transmit driving torque between a driving wheel and a driven inertia wheel. The driving wheel may itself be driven by means of a drive string that may frictionally engage a circular drive surface to permit the driving wheel to be rotated independently with limited slippage between the string and the drive surface. A fixed and uniform amount of energy can be imparted to the driving wheel and the driven wheel through a spring that is connected to the drive string and preloaded by a predetermined amount. A second inertia wheel can be mounted coaxially of the one inertia wheel and both wheels may operate with random motion through an interference coupling. The pawl and ratchet mechanism in one embodiment forms an escapement to provide intermittent drive to the wheels. The inertia wheel is rotationally unbalanced with a weight offset from the axis of rotation.

9 Claims, 18 Drawing Figures

ROTARY DRIVE MECHANISM FOR ENERGIZING TOYS, KINETIC SCULPTURES, OR THE LIKE

BACKGROUND OF THE INVENTION

The present invention relates to a mechanical drive mechanism that imparts rotary motion to inertia wheels and produces driving motion in items such as toys and kinetic sculptures. Kinetic sculptures are sculptures having moving parts, and the present invention is utilized in such sculptures to produce the motion.

SUMMARY OF THE INVENTION

The present invention resides in a rotary drive mechanism that converts energy from a spring, weight or motor into motion of parts of a toy, kinetic sculpture or the like. The drive mechanism includes a driven inertia wheel that is mounted on a shaft for free rotation and a driving wheel mounted coaxially of the inertia wheel on the shaft with a circular drive engagement surface. A pawl and ratchet mechanism interconnects the driving and driven wheels to permit motion of the driving wheel in one direction about the shaft to be transmitted to the driven inertia wheel and also permits the inertia wheel to rotate freely in the one direction independently of the driving wheel. The driving wheel is motivated through an elongated flexible drive member, such as a string or belt, that extends at least partially around and engages a circular drive surface of the wheel to impart rotary motion to the wheel when the elongated member is pulled.

Tensioning means, such as a spring or weight, connects with the elongated drive member for drawing the member over the drive surface of the wheel and produces wheel rotation in the one direction about the shaft on which the wheel is mounted.

In one embodiment of the invention, the tensioning means is connected with one end of the elongated drive member and a releasable handle is connected with the opposite end for preloading the spring by a predetermined amount and imparting corresponding energy to the wheels when the handle is released. In another embodiment, the rotary drive includes an escapement that periodically imparts energy to the wheels from a stored energy device, such as a drop weight or spring, just before motion stops.

DESCRIPTION OF THE PREFERRED EMBODIMENTS

Figure 1:
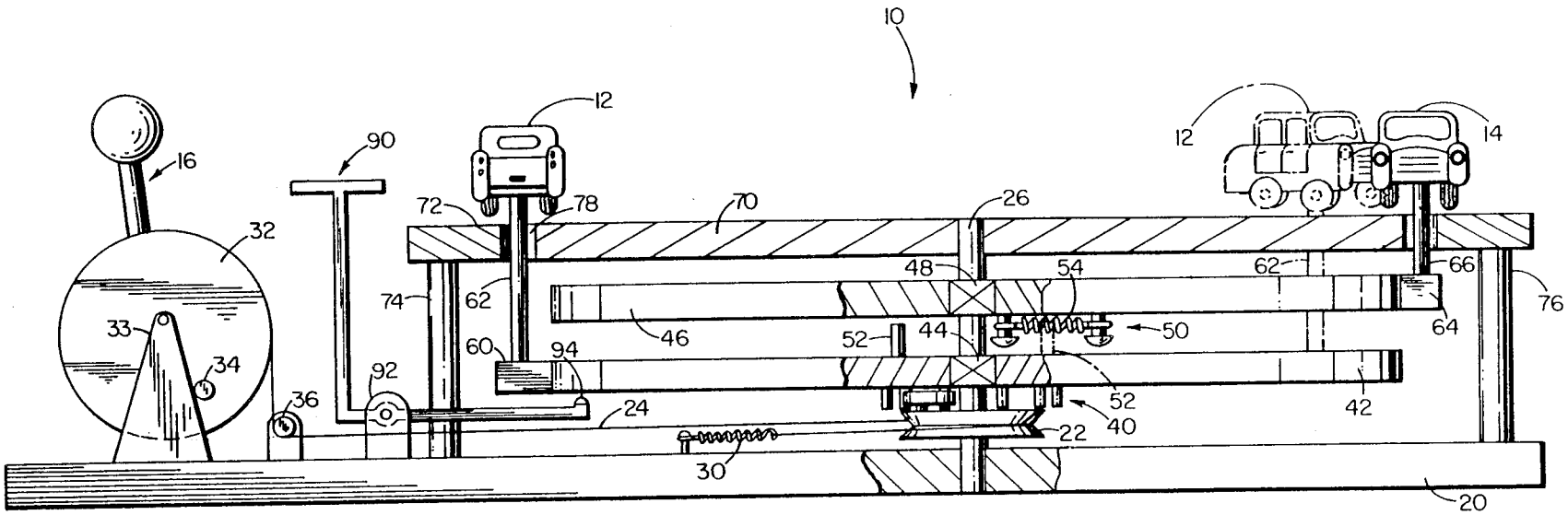
FIG. 1 is a partially sectioned horizontal elevation view of a toy incorporating the rotary drive mechanism of the present invention.
Figure 2:
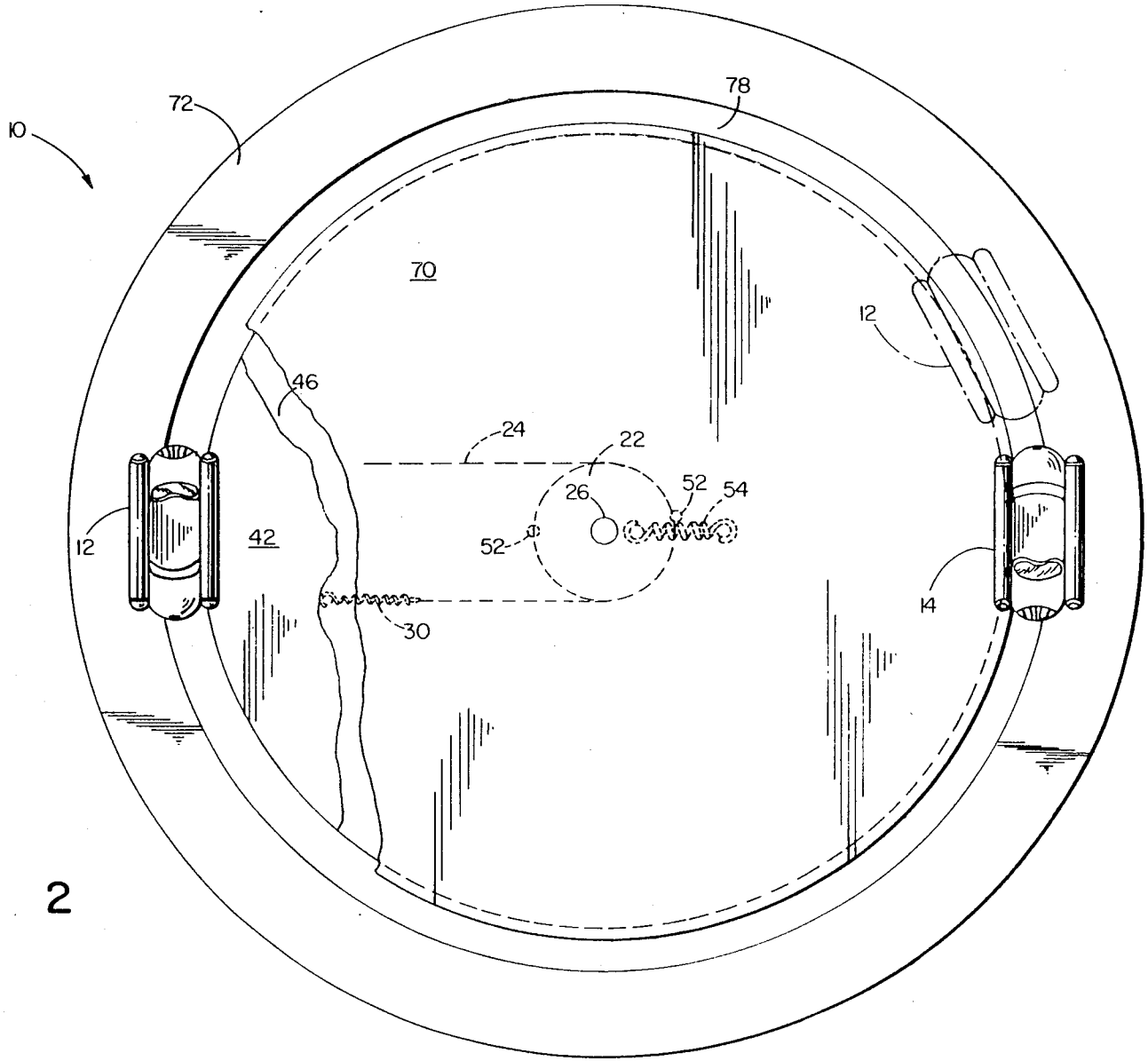
FIG. 2 is a plan view of the toy in FIG. 1 with portions broken away.

FIGS. 1 and 2 illustrate a toy which includes the rotary drive mechanism of the present invention in one embodiment. The toy, generally designated 10, includes two cars 12 and 14, which are driven around a circular track by the rotary drive mechanism when a manually actuated handle 16 is released. The motion of the car 12 in response to the handle is relatively uniform until the car approaches the car 14 as shown in phantom, and at this point, the cars appear to bump each other which propels the car 14 along the track in advance of the car 12. Depending upon the design, one or both cars may continue to move randomly and appear to bump one another until the energy in the drive mechanism has been dissipated. At any point, the handle 16 can be re-actuated to repeat the operation at the same energy level.

Although the rotary drive mechanism is shown in a toy, it should be understood that the mechanism may also be employed in kinetic sculptures to move artistic figures and other objects in a similar fashion.

The rotary drive mechanism for the toy 10 is mounted on a base platform 20 which provides the structural support for all of the components of the toy and holds the components in operative relationship with one another. The platform 20, as well as the other structural components of the toy, may be made of wood, plastic, or other materials that are suitable for the particular product in which the mechanism is found.

The drive mechanism as shown has a drive wheel 22 in the form of a pulley, and the circular exterior drive surface of the pulley is engaged in driving relationship with an elongated flexible drive member, such as a string 24. When one end of the string 24 is drawn over the circular drive surface, friction between the string and the surface causes the wheel to rotate about a central shaft 26 held fixedly within the base 20. Preferably, the wheel 22 is mounted on the shaft by means of bearings to reduce friction.

A uniform quantity of rotational energy is imparted to the drive wheel 22 by means of the actuating lever 16 connected wtih one end of the string 24 and a tensioning spring 30 at the opposite end. The handle 16 has a circular foot 32 which is pivotally mounted in a bracket 33 for rotation relative to the platform 20. A dowel 34 extending through the foot engages the direction, as viewed in FIG. 1, and the base platform 20 itself limits the rotation of the handle in the counterclockwise direction. Thus, the total available displacement of the handle 16 is fixed.

The string 24 extends from the drive wheel 22 under a guide pin 36 mounted on the base, and from the pin tangentially onto the circular foot 34 where the end of the string is securely fastened by any suitable means. As a result, rotation of the handle through its fixed displacement moves the string correspondingly. Such displacement is transferred through the drive pulley 22 to the tension spring 30 and stretches the string by an equivalent amount. It is a well-established principle of physics that the stretching of the spring amounts to work and introduces a pre-established amount of potential energy into the spring.

When the spring 30 has been stretched by the handle 16 and the handle is subsequently released, the potential energy of the spring is converted into kinetic energy which draws the string over the drive wheel 22 and imparts rotational motion to the wheel. In this regard, the length of the string 24 is initially set to provide a small degree of preload in the spring 30 which holds the string tightly against the circular drive surface.

The rotary drive mechanism further includes a pawl and ratchet mechanism 40 which interconnects the driving wheel 22 with a first driven inertia wheel 42. The inertial wheel is mounted on a shaft 26 coaxially of the driving wheel 22 by means of a bearing 44, and thus can rotate freely on the shaft relative to the driving wheel 22 in one direction defined by the pawl and ratchet mechanism.

A second inertia wheel 46 is mounted on the shaft 26 coaxially of the wheels 22 and 42 by means of a bearing 48. Driving motion is transmitted between the inertia wheels 42 and 46 by means of an interference mechanism 50 comprised of a drive pin 52 mounted in the wheel 42 and an intercepting spring 54 mounted on the wheel 46. It will be observed from the phantom position of the pin 52 in FIGS. 1 and 2 that the pin and spring are located at substantially the same radial distance from the shaft 46 and collide with one another when the wheels assume the relative positioning shown as well as a similar relative positioning locating the same pin or a second pin adjacent the opposite side of the spring. In each positioning, the cars 12 and 14 are closely adjacent each other, but do not actually contact.

The car 12 is supported from the wheel 42 by means of a projection 60 and a post 62. The car 14 is similarly supported from the wheel 46 by means of a projection 64 and a post 66. Thus both cars can revolve about the central shaft 26. The upper deck of the toy is comprised of a circular disk 70 and an outer ring 72. The disk is supported on the upper end of the stationary shaft 26, and the ring is mounted by means of a series of posts 74, 76 projecting upwardly from the base 20. The disk 70 and the ring 72 define an annular slot 78 in the upper deck, and the slot is located at the same radial distance from the shaft 26 as the posts 62 and 66 which support the cars. Thus, as the inertia wheels 42 and 46 rotate, the cars 12 and 14 appear to revolve around a circular track on the upper deck of the toy.

Figure 3:
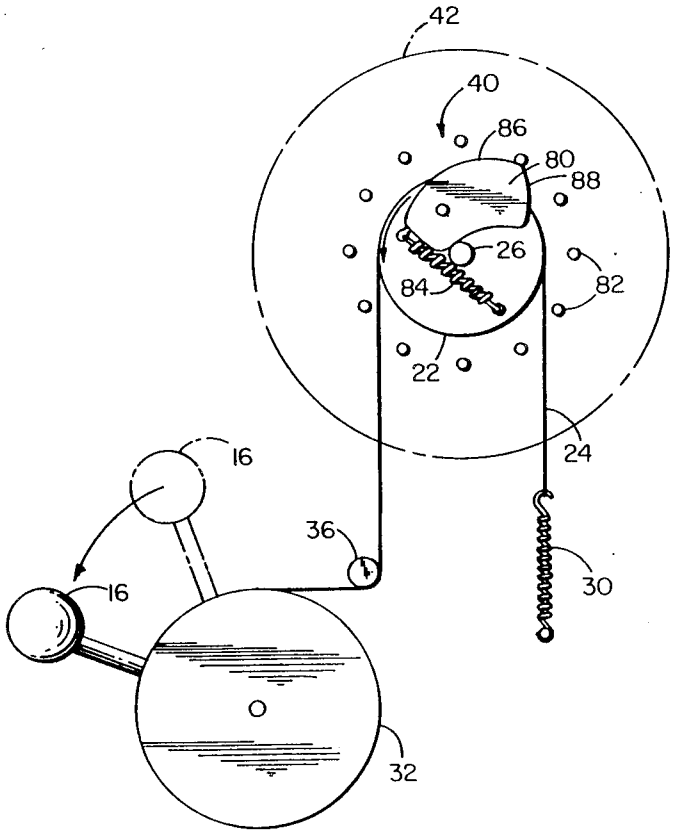
FIG. 3 is a plan view of the rotary drive mechanism in the toy of FIGS. 1 and 2 with the mechanism cocked and ready to impart rotation to an inertia wheel.

The operation of the rotary drive mechanism for the toy 10 is described in greater detail in connection with the FIGS. 3 and 4.

The pawl and ratchet mechanism 40 includes at least one pawl 80 pivotally mounted on the drive wheel 22 and a series of ratchet pins evenly distributed in a circular array on the inertia wheel 42. The pawl 80 is biased outwardly into engagement with the ratchet pins by means of a spring 84 and is shaped with a gradually sloping back surface 86 and a steeply sloped front surface 88 to perform its ratcheting function. Specifically, when the drive wheel is rotated in a counterclockwise direction about the shaft 26 by the handle 16, as shown in FIG. 3, the back surface 86 of the pawl engages the ratchet pins, and due to its gradual slope and small angle between the pin and the pawl at the point of tangency, the pawl is caused to pivot inwardly and slip past each pin under limited tension from the spring 84. Thus, a child may pull the actuating handle 16 backward, and the inertia wheel 42 together with the car 12 remains substantially stationary. At the same time, the tension spring 30 is stretched, as shown in FIG. 3, and a fixed quantity of potential energy is stored in the spring.

Figure 4:
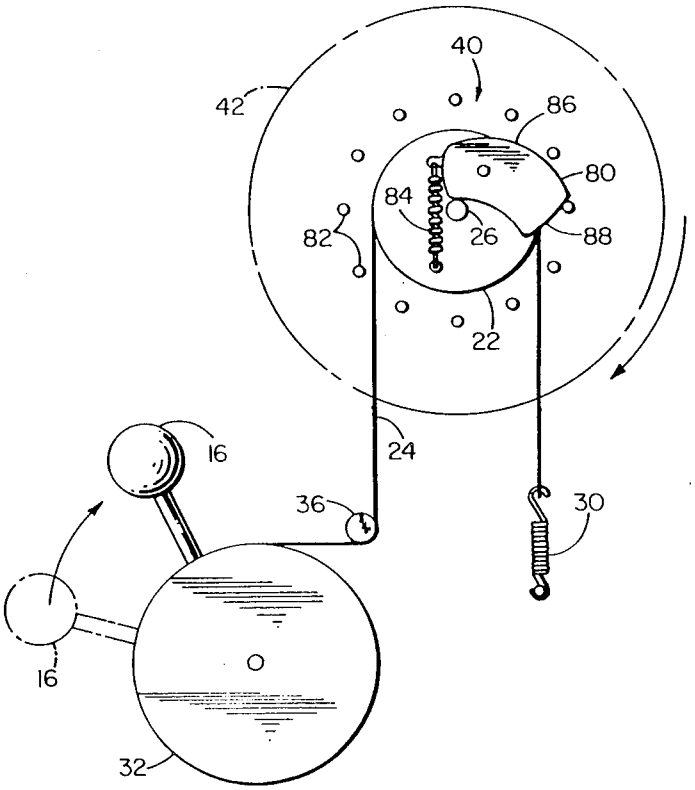
FIG. 4 is a plan view similar to FIG. 3 and shows the rotary mechanism after energy has been imparted to the inertia wheel.

When the handle 16 is released from the phantom position in FIG. 4, the tension of spring 30 pulls the string 24 over the circular peripheral drive surface of the driving wheel 22 and imparts a rotary motion to the wheel about the shaft 26. At the same time, the steep forward surface 88 of the pawl catches one of the ratchet pins 82 as shown and imparts rotational motion to the inertia wheel 42 in a clockwise direction.

As the wheel 42 begins to rotate, the car 12 travels around the disk 70 to the phantom position illustrated in FIGS. 1 and 2, and just prior to actual contact between the car 12 and the car 14, the pin 52 on the wheel 42 makes contact with the spring 54 on the wheel 46 and causes the car 14 to rotate in a clockwise direction. Thus, although the cars appear to collide or interact, they do not actually contact, and no damage occurs. The respective proportions of the energy imparted to the inertia wheels 42, 46 by the tensioning spring 30, and the velocities achieved by those wheels depends upon the masses of the wheels, including he cars. One wheel may stop while the other is moving, or two wheels may move simultaneously at different speeds. Whenever one car is about to make contact with the other, the pin 52 and spring 54 engage one another and change the relative speeds. The motions become random after the wheel 42 has been accelerated by the spring 30 through the ratchet mechanism 40 and continue until friction or other outside forces cause the wheels to stop.

A further feature in the toy 10 is a brake lever 90 pivotally mounted on the platform 20 by means of a bracket 92. A brake shoe or pad 94 at one end of the lever contacts the underside of the driven inertia wheel 42 and produces a braking force to slow or stop the wheel and the car 12. if the brake lever is pressed while both wheels are revolving, the car 14 catches up to the car 12 and appears to have a collision. If the braking force of the lever is sufficient to stop the driven inertia wheel and is released before the apparent collision, both cars will appear to collide and be repelled in opposite directions away from one another by the interference mechanism 50. In such case, the cars will possibly collide again elsewhere along the track 78 in reversed front to rear relationship.

One of the advantages of the drive mechanism, including the actuating handle 16, is that the spring 30 fixes the maximum energy that can be imparted to the wheels; thus, the design criteria for the toy can be based upon the components of the toy itself. Additionally, with frictional engagement between the drive wheel 22 and the string 24, a child can manually push the cars around the track in the counterclockwise direction without damaging the ratchet mechanism 40. In such case, the inertia wheels merely rotate on the shaft 26 and the string, which is not secured to the wheel 22, slips over the peripheral drive surface. Of course, a child can push the cars in the clockwise direction as well because of the inherent design of the ratchet mechanism.

It will be apparent that the spring 84, which operates the pawl 80, need not be used if centrifugal forces are adequate to wing the pawl to its outermost position when the actuating handle 16 is released. The spring, however, renders the mechanism gravity independent and maintains some contact between the pawl and the ratchet pins to produce a noticeable clicking noise as the handle 16 is drawn back to the cocked position shown in FIG. 3. The mounting of the pins 82 and ratchet 80 on the driving and driven wheels may be interchanged. The coupling between the two inertia wheels 42, 46 may be formed by other interfering devices such as another set of pawls and ratchets or two pins. When the two pins come in contact, a noise is produced that would simulate a crash between the two cars.

Figure 5:
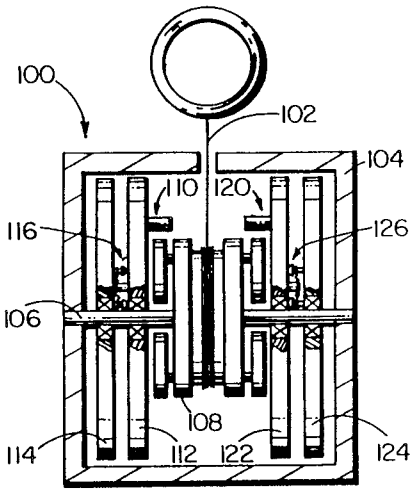
FIG. 5 is a horizontal elevation view of another toy in section and illustrates an alternative embodiment of the rotary drive mechanism.

FIG. 5 illustrates another embodiment of the rotary drive mechanism constructed in substantially the same manner as in the embodiment of FIGS. 1–4. In FIG. 5, however, the toy or novelty device, generally designated 100, has a pull string and ring 102, and enclosure 104 in which the drive mechanism is housed. The pull string 102 is wrapped around a drive wheel having the shape of a spool 108. The spool 108 is freely rotatable on a shaft 106 extending through the housing by means of a bearing. A coil spring (not shown) is connected between the spool and the shaft so that the string is effectively connected with the spring for tensioning and preloading the spring. When the string 102 is pulled out of the housing 104, the spool rotates and effectively winds the spring up, and when the string is released, the spring rotates the spool and pulls the string back onto the circular, cylindrical surface of the spool.

A ratchet mechanism 110 is interposed between one axial end of the spool 108 and a first inertia wheel 112. The mechanism 110 is identical to the ratchet mechanism in the embodiment of FIGS. 1–4 except that it includes a single ratchet pin on the inertia wheel and a plurality of pawls on the spool. When the string 102 is pulled outwardly, centrifugal forces cause one of the pawls to engage the ratchet pin on the inertia wheel, and the inertia wheel is thus driven in one direction about the shaft 106. A second inertia wheel 114 is also mounted on the shaft 106 and an interference device 116, such as a pin and spring mounted on the respective inertia wheels, transmits some or all of the motion from the wheel 112 to the wheel 114 in the same manner as the embodiment described above. The inertia wheels may be partially transparent or cut away with different designs so that the rotation of the two wheels causes the designs to change in a random fashion in accordance with the rotation of the wheels. Characters or ornamental items may also be mounted on the wheels for interaction with one another in the same manner as the cars in the embodiment of FIG. 1.

Another pawl and ratchet mechanism 120 is interposed between the spool 108 and a third inertia wheel 122 mounted by means of bearings for free rotation on the shaft 106. A fourth inertia wheel is similarly mounted adjacent the wheel 120 and an interference mechanism 126 corresponding to the mechanism 116 is interposed between the two inertia wheels.

The ratchet mechanism 120 is designed in the same manner as the ratchet mechanism 110, except that the pawls are arranged as mirror images in the mechanism 110 and, as a result, the inertia wheels 122 and 124 are driven in a direction about the shaft 126 opposite from the driving direction of the wheels 112 and 114 when the string 102 is retracted. The ornamentation on the wheels 122 and 124 may be the same as or different from the ornamentation on the wheels 112 and 114.

Accordingly, when the pull string 102 is drawn out of the housing 104, the spool 108 is rotated in one direction about the shaft 106 and the inertia wheels 112 and 114 are driven. At the same time, the coil spring between the spool and the shaft is tensioned, and when the pull string is released, the spring rotates the spool in the opposite direction, and the inertia wheels 122 and 124 are driven through the ratchet mechanism 120.

Figure 6:
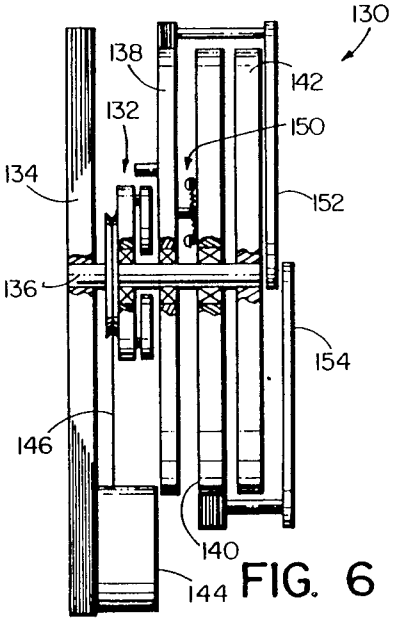
FIG. 6 is a horizontal elevation view of still a further toy utilizing the rotary drive mechanism with a drive motor.

FIG. 6 illustrates still a further embodiment of the rotary drive mechanism in a toy or kinetic sculpture 130. The drive for the device 130 is supported on a stationary plate 134 that has a vertical operative position as shown. A stationary shaft 136 projects horizontally from the plate 134 and the various components of the rotary drive for the toy 130 are mounted on the shaft. These components include the ratchet mechanism 132, which is identical to the mechanism 120 in FIG. 5, an unbalanced inertia wheel 18 mounted by means of a bearing for free rotation about the shaft 136, and another inertia wheel 140 mounted by means of a bearing for similar motion. A static cover disk 142 is mounted at the outer end of the shaft.

A small electric motor 144 provides the motive force for rotating the wheels 138 and 140 and is coupled to the wheels through the ratchet mechanism 132 by means of a looped drive belt or string 146. When the unbalanced inertia wheel 138 is driven by the ratchet mechanism, the wheel is rotated initially to lift the unbalanced portion of the wheel from below the shaft 136 to a balance point over the shaft, and as the center of gravity of the unbalanced portion passes over the shaft and begins to fall, the wheel accelerates in advance of the ratchet mechanism and motor until center of gravity reaches the low point. Eventually, the ratchet mechanism reengages the unbalanced inertia wheel and again lifts the unbalanced portion of the wheel over the shaft 136.

Sometime during the rotation of the unbalanced inertia wheel 138, an interference device 150 corresponding to the device 126 in FIG. 5 engages the second inertia wheel 142 and causes the second wheel to rotate randomly relative to the unbalanced wheel. An ornamental character 152 is connected with the inertia wheel 138 and an ornamental character 154 is connected with the inertia wheel 140. Depending upon the masses of the wheels and characters, the speed of rotation of the ratchet mechanism 132 and the resiliency of the interference mechanism 150, the characters will rotate about the shaft 136 relative to the cover disk 142 and appear to interact with one another in a random fashion.

Figure 7:
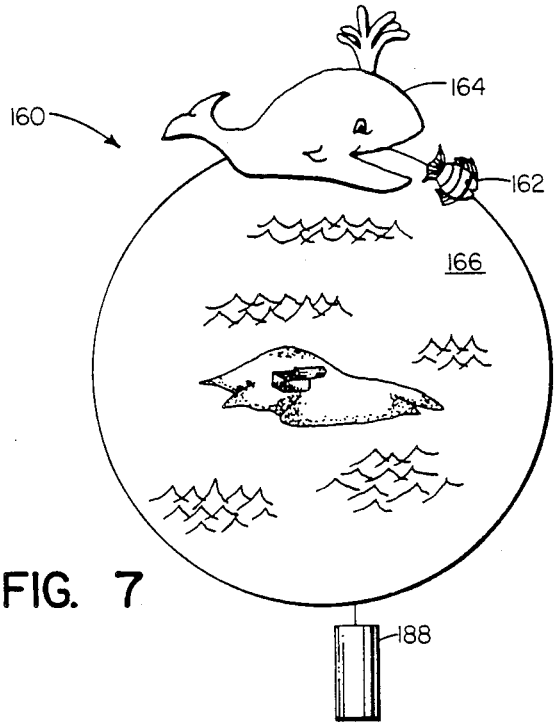
FIG. 7 is a horizontal elevation view of a toy or kinetic sculpture that includes an intermittent rotary drive of the present invention.
Figure 8:
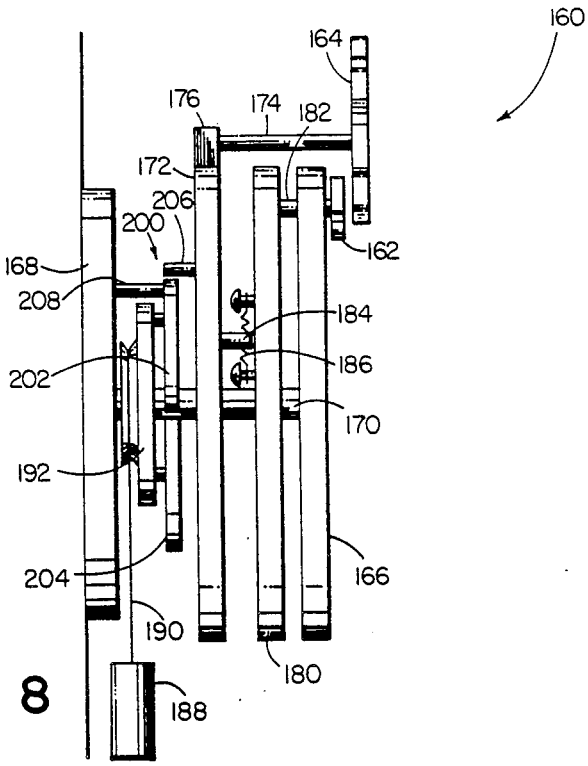
FIG. 8 is a side elevation view of the toy in FIG. 7 and illustrates the intermittent rotary drive in detail.
Figure 9:
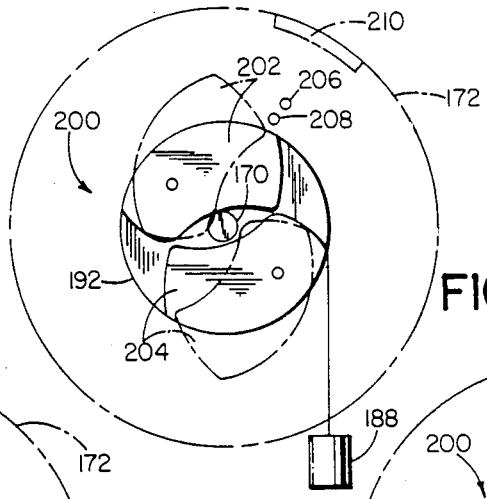
FIGS. 9–14 illustrate the intermittent rotary drive at sequential steps in its operation.

FIGS. 7 and 8 illustrate a toy or sculpture, generally designated 160, which includes another embodiment of the drive producing intermittent random motion. The ornamental items, which are moved by the drive, include a small fish 162 and the whale 164. Both the fish and the whale revolve around a disk 166 which bears a seascape consistent with the fish and whale characters.

The motion of the fish and whale is somewhat similar to the two cars illustrated in the embodiment of FIGS. 1-4; however, the rotary drive includes an escapement mechanism which periodically releases additional energy to keep the fish and whale in motion for prolonged periods of time.

The toy 160 has a base platform 168 and a stationary shaft 170 projecting outwardly in a horizontal position when the platform is hung or supported vertically from a wall as shown in FIG. 8. A first inertia wheel 172 is mounted on the shaft 170 for free rotation about the shaft, and the whale 164 is supported in offset relationship from the wheel 172 by means of an axially extending dowel 174 and radial projection 176. For reasons explained in greater detail below, the wheel 172 is rotationally unbalanced, and if allowed to come to a rest position, the unbalanced portion of the wheel seeks a low point with the center of gravity of the wheel immediately below the shaft 170.

A second inertia wheel 180 is mounted on the shaft 170 coaxially with the first wheel 172, and is supported by a bearing for free rotation about the shaft relative to the first inertia wheel and the disk 166 which is secured in a fixed position at the end of the shaft. The fish 162 is supported from the second inertia wheel 180 by means of a projection and an axially extending dowel 182 in substantially the same manner as the whale 164. In order to allow the fish to disappear in the whale's mouth when the whale overtakes the fish as the inertia wheels 172 and 180 revolve, the fish is offset in the axial direction of shaft 170 from the whale as indicated in FIG. 8.

In this connection, an interference mechanism comprised of a pin 184 fixed in the inertia wheel 172 and an intercepting spring 186 mounted on the second inertia wheel 180 are situated at radial and azimuthal positions on the two wheels relative to the whale and the fish so that the pin engages the spring as the fish disappears within the whale's mouth. Interference between the spring and pin causes the rotational energy of the first inertia wheel 172 to be transmitted to the second inertia wheel 180 and, as a result, the fish will effectively appear to be expelled from the whale's mouth as the speed of the second wheel is suddenly increased. From this same interaction and motion of the wheels, numerous amusing and entertaining illusions can be created. The second wheel 180 rotates randomly each time the interference spring and pin collide with one another and the particular motions depend upon the inertia of each wheel, the degree of unbalance in the wheel 172, and the resiliency of the interference mechanism.

Rotation of the two inertia wheels 172 and 180 is produced by means of a novel escapement mechanism 200 in the intermittent drive for the toy. Energy is imparted to the wheels through the mechanism from an energy storage device, such as the drop weight 188 or a manually wound spring. The drop weight 188 is suspended by a drive cord 190 from a drive wheel 192. The cord 190 is wrapped around a circular drive engagement surface of the wheel, so that the weight 188 applies torque to the wheel about the shaft 170.

Escapement mechanism 200 is interposed between the drive wheel 192 and the driven unbalanced inertia wheel 172 and causes the driving wheel to engage and rotate the inertia wheel in one direction about the shaft 170. The escapement also allows the unbalanced inertia wheel to rotate in one direction in advance of the driving wheel when the driving wheel is stopped or rotating at a speed slower than that of the inertia wheel. The construction and operation of the escapement mechanism 200 is described in greater detail in the sequence of views found in FIGS. 9–14.

The escapement mechanism 200 shown in FIGS. 9–14 includes a set of pawls 202, 204 pivotally connected to the drive wheel 192 for movement between projecting positions extending outwardly away from the axis of shaft 170 and retracted positions closer to the shaft. The mechanism further includes a single ratchet pin 206 fixedly secured in the inertia wheel 172 along or closely adjacent to the same azimuth as the center of gravity of the unbalance weight 210 of the inertia wheel 172, and the pin extends parallel to the shaft 170 into the plane of the pivotally mounted pawls 202 and 204. A stationary stop 208 in the form of a pin projects into the plane of the pawls from the base platform 168. The stop 208 is located radially closer to the shaft 170 than the ratchet pin 206 so that the pawls 202 or 204 may be engaged with the stop while the inertia wheel 172 and the ratchet 206 rotate freely. The components of the escapement mechanism cooperate to cause energy from the drop weight 188 to be intermittently imparted to the inertia wheels 172 and 180, and are brought into operation whenever the motion of the inertia wheel 172 approaches a halt.

Figure 10:
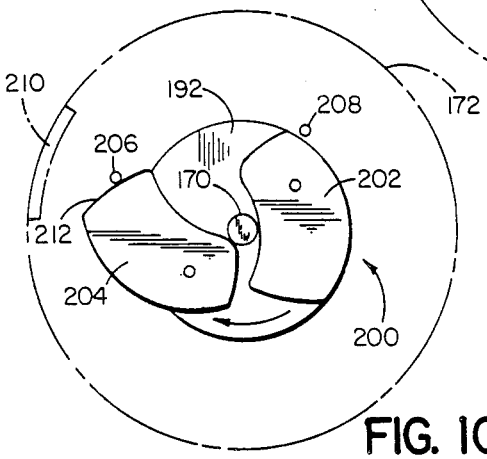

The sequence of operation, which is cyclic in character, is arbitrarily assumed to begin in FIG. 10. FIG. 10 illustrates the positioning of the drive wheel 192 and the inertia wheel 172 as the leading driving surface 212 of the pawl 204 engages the ratchet pin 206 while the drive wheel 192 is rotated in the clockwise direction. The pawl initially assumes the extended position at the low point in its rotation due to the forces of gravity which swing the pawl about its pinion in the drive wheel 192. The pivotal motion of the pawl 204 outwardly is limited by a stop or by engagement with the shaft 170.

Figure 11:
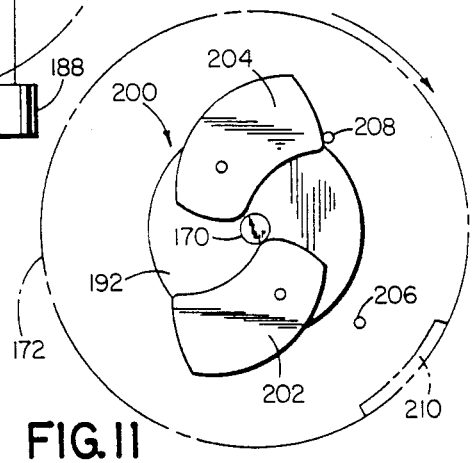

When the pawl 204, which lifts the unbalance weight, engages the stop 208, as in FIG. 11, rotation of the drive wheel 192 is interrupted. At the same time, the unbalance weight 210 passes the uppermost position in its rotation, and gravitational forces take over and accelerate the inertia wheel 172 as the weight falls toward its lowest point.

Figure 12:
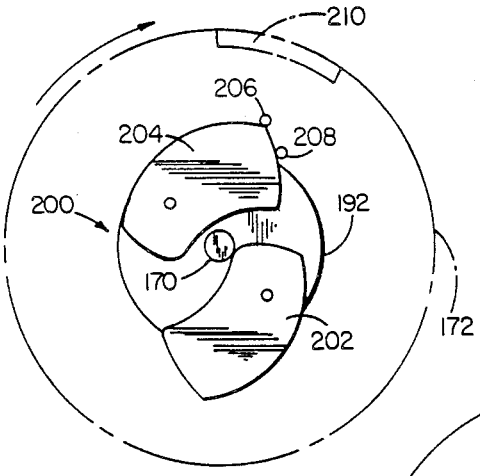

FIG. 12 shows the inertia wheel 172 in the revolution immediately following the condition in FIG. 11, and it is apparent that the pawl 204 has been moved slightly toward the retracted position by the pin 206, but the stop 208 still impedes drive wheel rotation.

As the inertia wheel 172 continues to rotate due to the energy that was imparted to the wheel by the drop weight 188 and drive wheel 192, the interference mechanism 184, 186 between the inertia wheels 172 and 180 causes the wheels to rotate in a random fashion in the clockwise direction about the shaft 170. During this period of time, the whale 164 and fish 162 appear to move independently, and the fish 162 periodically appears to be swallowed by and expelled from the whale 164.

Figure 13:
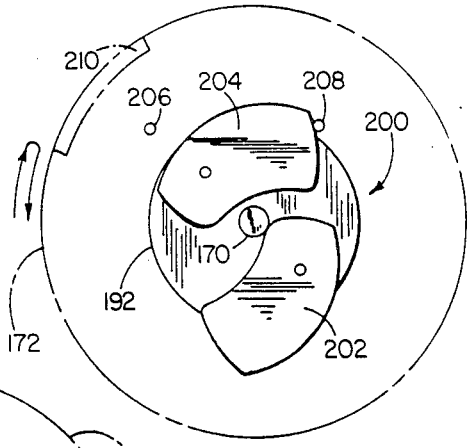
Figure 14:
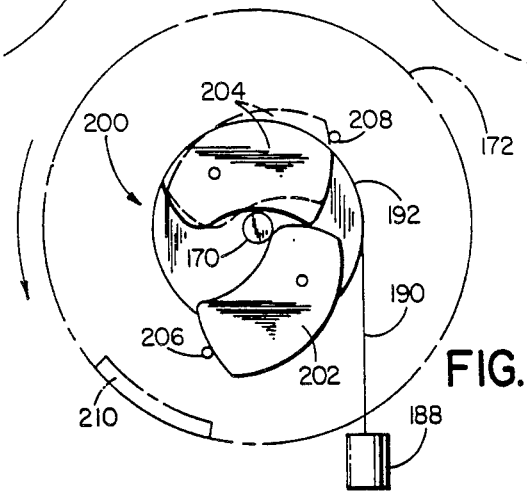

Eventually, the inertia wheels slow down, and the wheel 172 stops and reverses rotation when the unbalance weight 210 rises toward the top of the rotation as shown in FIG. 13. The pawl 202 drops into the extended position as shown, and when the unbalance weight 210 drops back toward the low point in rotation, the ratchet pin 206 engages the pawl 202 as shown in FIG. 14. The impact of the ratchet pin on the pawl 202 disengages the pawl 204 from the stop 208, and the pawl 204 drops to the retracted position from the phantom position so that the drive wheel 192 is again free to rotate and impart energy to the inertia wheel 172. The cycle of operation is repeated until the cord 190 holding the drop weight is unwound or the energy storage device is expended.

Figure 15:
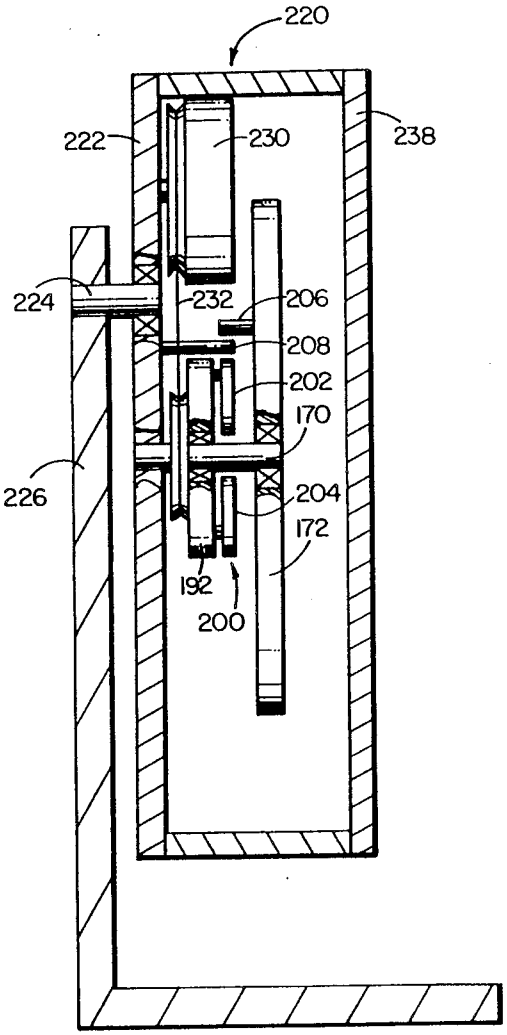
FIG. 15 is a horizontal elevation view showing a toy with a rotatable base and the rotary drive of the present invention.
Figure 16:
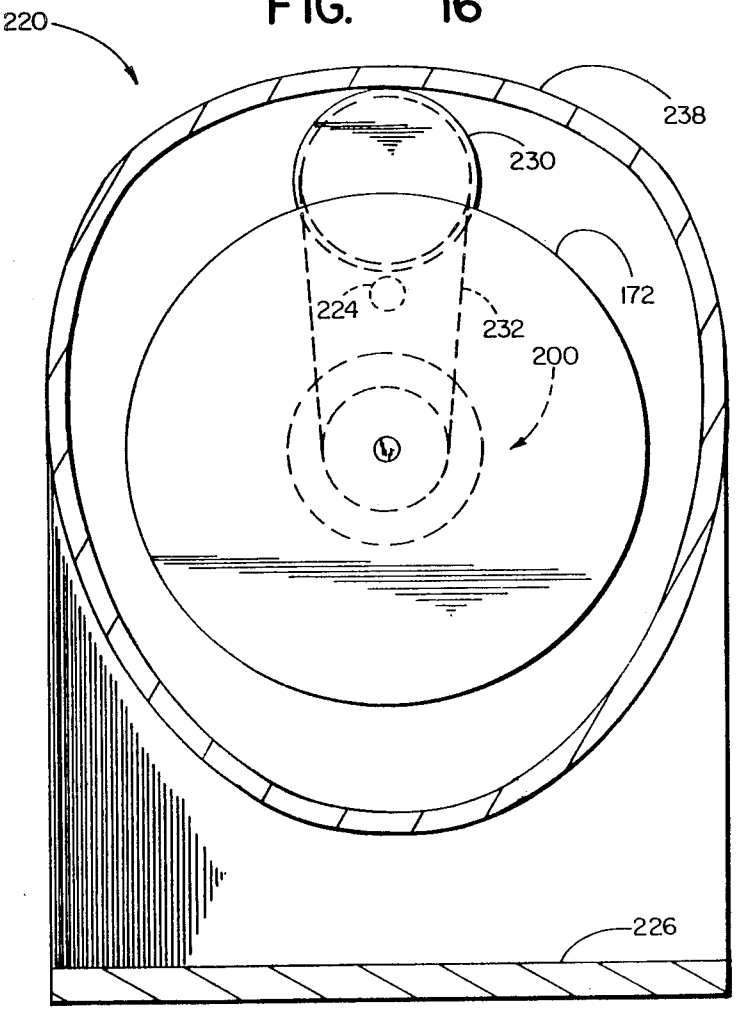
FIG. 16 is a front elevation view partially in section and shows the toy of FIG. 15.

FIGS. 15 and 16 illustrate further applications of the intermittent drive mechanism defined in FIGS. 7–14 in another toy. Previously described components bear the same reference numerals and for brevity are not described again.

The toy, generally designated 220, incorporates the pawl and ratchet mechanism 200 and an unbalanced inertia wheel 172 as described above. The mechanism is mounted in a movable base 222 that is pivotally supported on a horizontal shaft 224 for rotation about the shaft relative to a fixed base 226. Energy is imparted to the inertia wheel 172 form a battery driven or key wound drive motor 230 connected to the drive wheel 192 through an endless drive belt or string 232. When the drive wheel 192 is halted by the stop 208, the motor 230 either stalls or friction between the drive belt 232 of the motor and the drive wheel permits slippage.

A cover 238 enclosing the drive mechanism including the drive motor 230 may be provided with holes or cutouts that expose the inertia wheel 172. For example, the cover 238 may have an oval configuration such as shown in FIG. 16 to simulate a face, and holes in the cover at the location of the cheeks may expose the inertia wheel 172. As the wheel rotates, the color of the cheeks may change and cause the appearance of the face to change between a flush and a pale condition.

In operation, the drive motor 230 causes the motion of the drive wheel 192 to be transmitted to the unbalanced inertia wheel 172. As the unbalanced inertia wheel rotates, forces imparted through the shaft 170 cause the movable base 222 to wobble the entire assembly, apart from the fixed base 226, on the shaft 224. Additionally, when the inertia wheel slows down, reverses, and is again engaged with the pawls of the mechanism 200, the impulse of energy due to the impact of the ratchet pin and the pawls is sufficient to turn the entire cover 238 over in a complete revolution. Thus, with the face design on the cover, the face turns upside down and then assumes an upright position again. Several revolutions may occur depending upon the various weights of the components and the degree of unbalance about the axis of the shaft 224.

Figure 17:
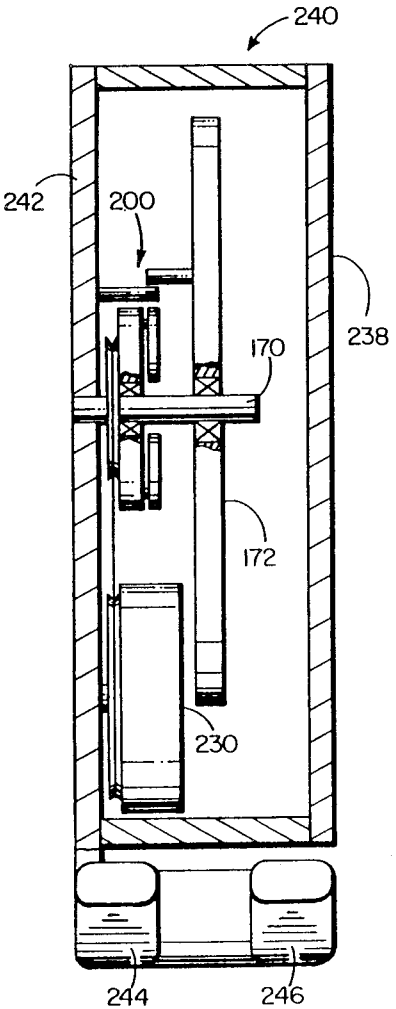
FIG. 17 is a horizontal side elevation view partially in section and shows a toy with a rocking base and the rotary drive of the present invention.
Figure 18:
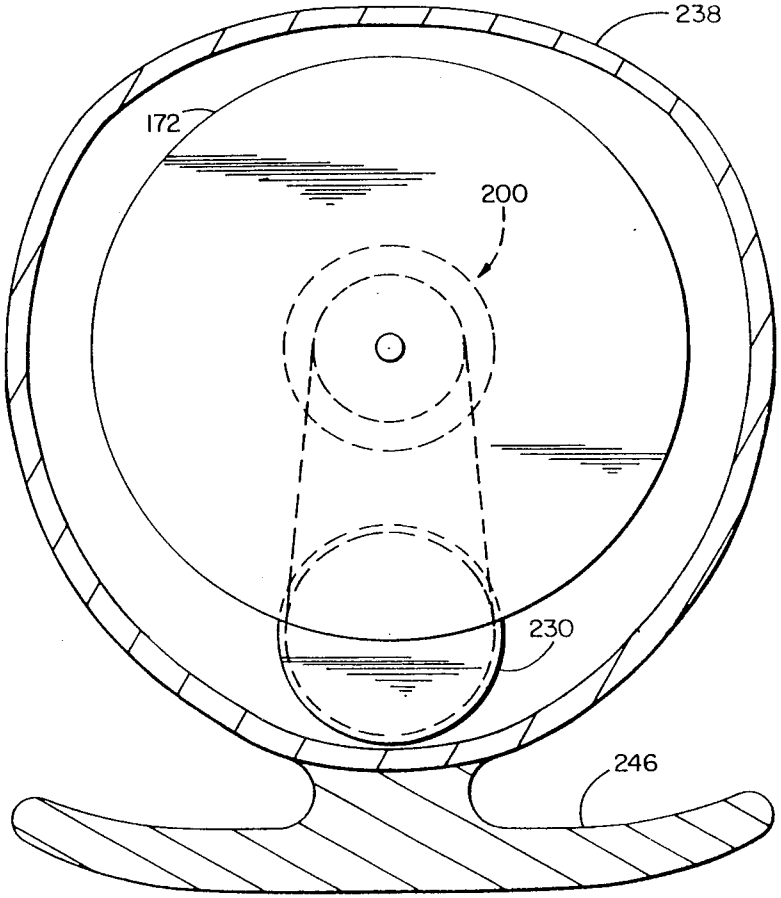
FIG. 18 is a partially sectioned front elevation view of the toy in FIG. 17.

FIGS. 17 and 18 illustrate a further toy or sculpture, generally designated 240. The toy 240 is similar to that shown in FIGS. 15 and 16 and utilizes the same pawl and ratchet mechanism 200, inertia wheel 172, and drive motor 230. In this toy, the shaft 170 is mounted in a base 242 that includes a pair of rockers 244, 246. As the unbalanced inertia wheel is driven through the pawl and ratchet mechanism by the motor 230, the random motions of the wheel are transmitted to the base 242 and cause the toy to rock with a random motion.

Accordingly, a mechanical drive for a toy or kinetic sculpture has been disclosed with a pawl and ratchet mechanism. The drive in one embodiment imparts a fixed quantity of energy in a single operation, and in another embodiment imparts energy intermittently whenever the motion of the toy is about to stop.

While the present invention has been described in a preferred embodiment, it should be understood that numerous modifications and substitutions can be had without departing from the spirit of the invention. For example, the motion of the inertia wheels can be varied by changing the masses or the degree of unbalance in the wheels. In toys or sculptures which have two inertia wheels and one inertia wheel is driven by a motor, the irregular motion of the wheels is promoted by unbalancing the second of the wheels. The term "wheel", as used within the context of this specification and the subsequent claims, is intended to comprehend any type of rotating device with or without a circular configuration. Accordingly, the present invention has been described in several preferred embodiments by way of illustration rather than limitation.

I claim:

1. An intermittent rotary drive for toys, kinetic sculptures, and the like comprising:

a mounting structure defining a horizontal axis of rotation in an operative position of the structure;

a driving wheel mounted on the structure for rotation about the horizontal axis;

motive means connected to the driving wheel for rotating the driving wheel in one direction about the horizontal axis;

a driven inertia wheel mounted coaxially of the driving wheel for free rotation about the axis, the driven inertia wheel being rotationally unbalanced with a heavier portion of the wheel disposed at one side of the wheel in offset relationship from the axis of rotation whereby the heavier portion seeks a low point when rotation of the wheel about the horizontal axis stops; and escapement means intermittently connecting the driving and driven wheel for causing the driving wheel to engage and rotate the driven wheel in the one direction about the axis and allowing the driven wheel to rotate in the one direction relative to the driving wheel whereby the driven wheel can advance rotationally ahead of the driving wheel in the one direction and the heavier portion of the driven wheel can stop or reverse the rotation in the one direction until the escapement means brings the driving wheel and the driven wheel back into engagement.

2. An intermittent rotary drive as defined in claim 1 wherein:

the escapement mechanism includes two pawls on the driving wheel and one ratchet on the driven unbalanced inertia wheel, each of the pawls having a projecting position extending outwardly away from the horizontal axis and a retracted position closer to the axis; and a stop is supported on the mounting structure and engages one of the pawls in the projecting position to arrest the rotation of the driving wheel by the motive means and allow the driven wheel to advance rotationally ahead of the driving wheel until the pawl is disengaged from the stop.

3. An intermittent rotary drive as defined in claim 2 wherein:

the pawls are positioned on the driving wheel and the ratchet is positioned on the driven inertia wheel relative to the heavier portion of the wheel so that the ratchet engages the pawl not engaged with the stop when the heavier portion of the inertia wheel stops and seeks a low point in rotation while the other pawl engages the stop and arrests the motion of the driving wheel.

4. An intermittent rotary drive as defined in claim 3 wherein the two pawls are mounted on the driving wheel at positions on diametrically opposite sides of the wheel; and each of the pawls is pivotally mounted on the wheel for movement between the projecting and retracted positions under the influence of gravitational and inertial forces.

5. An intermittent rotary drive as defined in claim 1 further including another inertia wheel mounted coaxially of the unbalanced inertia wheel and freely rotatable about the axis; and interference means cooperatively and intermittently interconnecting the two inertia wheels for transfer of rotational energy from one wheel to the other.

6. An intermittent rotary drive as defined in claim 1 wherein:

the mounting structure comprises a stationary base having an operative position and a rotatable base mounted on the stationary base for rotation about a horizontal shaft in the operative position, and the driving and the driven wheels are mounted on a horizontal mounting axis in the rotatable base, the mounting axis extending in the same direction as the horizontal shaft.

7. An intermittent rotary drive as defined in claim 1 wherein:

the mounting structure defining the horizontal axis of rotation includes a rocking base holding the axis of rotation horizontal during rocking motions of the base.

8. A rotary drive mechanism as defined in claim 5 wherein the interference means comprises a pin projecting from one inertia wheel parallel to the axis of rotation and a resilient spring mounted on the other inertia wheel at a radial position intercepting the pin.

9. A rotary drive mechanism as defined in claim 5 wherein a first ornamental item is mounted on one of the inertia wheels and a second ornamental item is mounted on the other of the inertia wheels; and the ornamental items are positioned to simulate interaction with one another at said selected rotational positions of the one wheel relative to the other when the interference means transfers energy between the two wheels.

* * * * *